US006175713B1

(12) United States Patent
Uehara et al.

(10) Patent No.: US 6,175,713 B1
(45) Date of Patent: Jan. 16, 2001

(54) IMAGE RECORDING APPARATUS WITH REDUCED THERMAL ENERGY REQUIREMENTS

(75) Inventors: Yasuhiro Uehara; Yasuhiro Kusumoto; Yoshio Kanesawa, all of Nakai-machi (JP)

(73) Assignee: Fuji Xerox Co., Ltd., Tokyo (JP)

( * ) Notice: Under 35 U.S.C. 154(b), the term of this patent shall be extended for 0 days.

(21) Appl. No.: 09/299,006

(22) Filed: Apr. 26, 1999

(30) Foreign Application Priority Data

Jun. 4, 1998 (JP) ..... 10-172242

(51) Int. Cl.[7] ..... G03G 15/16; G03G 15/20; H05B 6/14

(52) U.S. Cl. ..... 399/307; 219/619; 399/329

(58) Field of Search ..... 219/600, 619; 399/67, 302, 307, 308, 320, 335; 430/126

(56) References Cited

U.S. PATENT DOCUMENTS 5,568,235 * 10/1996 Amarakoon ..... 399/307

FOREIGN PATENT DOCUMENTS 49-78559 7/1974 (JP) .
50-107936 8/1975 (JP) .
57-163264 10/1982 (JP) .
64-1027 1/1989 (JP) .
2-106774 4/1990 (JP) .
8-76620 3/1996 (JP) .

* cited by examiner

*Primary Examiner*—Sophia S. Chen
*Assistant Examiner*—Hoang Ngo
(74) *Attorney, Agent, or Firm*—Oliff & Berridge

(57) ABSTRACT

In an image recording apparatus in which a toner image on a toner image holding and conveying member is transferred onto a recording member and is fixed at the same time, the change of charging characteristics or the like by accumulation of heat in the apparatus is prevented, the toner image is certainly transferred and fixed onto the recording member with small consumed energy, and high speed print can be made. An intermediate transfer material on which a toner image is primarily transferred is disposed at a position facing a photosensitive drum, and a pressing roller for pressing the toner image against the recording member is disposed at the downstream side in the conveying direction of the transferred toner image. At the upstream side of the secondary transfer portion where the pressing roller is pressed, an electromagnetic induction heating unit for melting the toner image on the intermediate transfer material is disposed. The intermediate transfer material includes a conductive layer therein, and when the electromagnetic induction heating unit generates fluctuating magnetic field, the conductive layer is heated by eddy current. The toner is heated up to a temperature not less than the softening point temperature by this heat, and is instantly transferred by press contact with the recording member. The toner is cooled while it passes through the secondary transfer portion.

10 Claims, 6 Drawing Sheets

IMAGE RECORDING APPARATUS WITH REDUCED THERMAL ENERGY REQUIREMENTS

BACKGROUND OF THE INVENTION

1. Field of the Invention

The present invention relates to an image recording apparatus in which a latent image is formed on an image holding material, a toner is selectively adhered to this to make a visible image, and then, it is transferred and fixed onto a recording member such as a sheet, and specifically to an image recording apparatus such as an electrophotographic recording apparatus, an electrostatic recording apparatus, an ionography, and an apparatus for forming an image using a magnetic latent image.

2. Description of the Related Art

Hitherto, as an image recording apparatus for reproducing an image signal or the like on a recording member such as a sheet, various systems of apparatuses have been put to practical use. For example, there is an apparatus in which a latent image is formed on an image holding material such as a photosensitive drum, a toner is selectively adhered to this to make a visible image, and this toner image is directly transferred to a recording member. There is also an apparatus in which a toner image is temporarily transferred onto an intermediate transfer material, and then, it is transferred onto a recording member.

The system in which an intermediate transfer material is used and a toner image is temporarily transferred onto this, is frequently applied to an apparatus for forming a color image. Toner images of multiple colors are superimposed and transferred onto the intermediate transfer material to form a full-color toner image, and this can be collectively transferred onto a recording member. Such a system has merits that mixture of toners of different colors stored in a developing unit can be prevented, and a full-color image can be formed in a short time by making a so-called tandem apparatus in which multiple image holding materials are provided. Moreover, in the image recording apparatus using the intermediate transfer material, when a toner is transferred from the intermediate transfer material onto the recording member, the toner is heated and melted, and the softened toner is pressed against the recording member, so that transfer and fixing can be carried out at the same time. That is, in the case where transfer is directly carried out to a recording member from an image holding material with a peripheral surface on which a toner image is formed, when the toner is heated and melted, a photosensitive material layer frequently used in the image holding material is also heated, so that its characteristics are changed and excellent image formation becomes impossible. However, when a toner image is temporarily transferred onto the intermediate transfer material and is further transferred onto the recording member, the influence of temperature upon the image holding material can be reduced, and the transfer and fixing can be carried out at the same time.

Incidentally, if an image holding material is not easily influenced by temperature as in ionography, the method in which a toner image is heated so that transfer and fixing are carried out at the same time, can also be used in the case where the image is directly transferred from the image holding material to a recording member.

There have been proposed some image recording apparatuses using the intermediate transfer material in which when a toner image is transferred from the intermediate transfer material onto the recording member, the toner image is heated so that transfer and fixing are carried out at the same time. Such an apparatus is disclosed in, for example, Japanese Patent Unexamined Publication No. Hei. 2-106774, No. Sho. 49-78559, No. Sho. 50-107936, and No. Sho. 57-163264, and Japanese Patent Publication No. Sho. 64-1027.

In the technique disclosed in Japanese Patent Unexamined Publication No. Hei. 2-106774, a recording member is heated prior to transfer of a toner image onto an intermediate transfer material, and the toner on the intermediate transfer material is melted by the heat of the recording member, and is transferred and fixed onto the recording member.

In the techniques disclosed in Japanese Patent Unexamined Publication No. Sho. 49-78559 and No. Sho. 50-107936, a recording member is not heated, but a toner on an intermediate transfer material is heated by a radiation heating means up to its melting temperature, and the intermediate transfer material and the toner image softened on this are pressed against the recording member, so that transfer and fixing are carried out.

In the technique disclosed in Japanese Patent Unexamined Publication No. Sho. 57-163264, an intermediate transfer material and a toner image transferred thereto are previously heated, and in a state where a recording member is heated, both are pressed against each other, so that the toner image is transferred and fixed onto the recording member.

In the technique disclosed in Japanese Patent Publication No. Sho. 64-1027, toner is preliminarily heated before a nip portion (transfer and fixing region) where a toner image on an intermediate transfer material is pressed against a recording member. That is, a belt-like intermediate transfer material is wound around a heating roller at 90° or more, and the toner is preliminarily heated before the nip portion by using the heat of the heating roller, so that the temperature is raised up to the vicinity of the melting temperature of the toner. Thereafter, the toner is further heated and melted at the nip portion, and the toner image is transferred and fixed onto the recording member.

However, the foregoing conventional techniques have problems described below.

The technique disclosed in Japanese Patent Unexamined Publication No. Hei. 2-106774 is preferable since the recording member is heated so that temperature rise of the intermediate transfer material is low and a bad thermal influence upon the image holding material is little. However, utilization efficiency of heat is low, and a large amount of heat energy is consumed for heating of the recording member. Especially in the case where image formation is carried out at high speed, it is necessary to increase the output of a unit for heating the recording member, so that the consumed electric power of the entire apparatus is increased. Besides, when interruption of conveyance of the recording member, a so-called jam occurs, since the recording member (generally, a PPC sheet) is heated to a high temperature, there is also a defect that the danger of firing is high.

The techniques disclosed in Japanese Patent Unexamined Publication No. Sho. 49-78559 and No. Sho. 50-107936 use a radiation heating system as means for selectively heating the toner, so that substantial thermal efficiency becomes low as compared with the heating means using thermal conduction such as a heating roller.

Since the technique disclosed in Japanese Patent Unexamined Publication No. Sho. 57-163264 heats any of the intermediate transfer material, the toner, and the recording member, there is a merit that the temperature of the intermediate transfer material can be set low. Besides, heat conduction between the toner image on the intermediate transfer material and the recording member at the press contact portion is low, and lowering of fluidity of the toner is lessened, so that the toner is sufficiently permeated into the recording member and is transferred from the intermediate transfer material. However, the temperature of the toner at the time when it is separated from the intermediate transfer material is higher than the toner softening point temperature, and the toner is in a fluid state, so that there is a tendency that the toner is divided and is apt to be offset to the side of the intermediate transfer material. Moreover, since any of the intermediate transfer material, the toner, and the recording member are heated, the consumed energy becomes high. Moreover, there is a problem that heat is conducted to the image holding material side by the circular movement of the intermediate transfer material heated by the heating roller, so that the temperature of the periphery of the image holding material is increased and the charging function is damaged. There also occurs a problem that the toner is melted in the vicinity of the developing unit by the temperature rise of the image holding material, or the toner is adhered to a cleaning blade or the like. On the other hand, in such a mechanism, when an attempt is made in order to prevent the conduction of heat of the intermediate transfer material to the image holding material side, a relatively large cooling apparatus comes to be required. Thus, the cost of the apparatus is greatly increased.

In the technique disclosed in Japanese Patent Publication No. Sho. 64-1027, since a toner is preliminarily heated before a nip portion (transfer and fixing region), the set temperature of the heating roller can be made low. However, since the toner and the recording member are again heated at the nip portion, the total energy required for fixing becomes large similarly to the foregoing technique.

As described above, in the image recording apparatus of the system in which toner images are temporarily transferred onto an intermediate transfer material and the toner images are collectively transferred onto a recording member and are fixed at the same time, any apparatus has some problems. The main problems of these are summarized into three points as follows.

The first problem is that when the toner images on the intermediate transfer material are collectively transferred onto the recording member at a secondary transfer portion, and at the same time, they are fixed by heating, the intermediate transfer material heated up to a high temperature is conveyed to a contact portion against the image holding material, so that the temperature of the image holding material is raised. When the temperature of the image holding material is raised like this, the charging characteristics, photosensitive characteristics and the like are changed, so that stabilization of images becomes difficult. Besides, there is also a problem that the toner is adhered to peripheral members through the temperature rise of the image holding material.

A second problem is that a large amount of thermal energy for melting the toner on the intermediate transfer material and for transferring and fixing it onto the recording member becomes necessary, so that consumed energy is increased. In general, thermal capacity of the recording member and the intermediate transfer material is large, so that a large amount of thermal energy becomes necessary to raise the temperature of those.

A third problem is that since the recording member is pressed in the state where the toner is heated and melted, when the recording member is separated from the intermediate transfer material, a part of the melted toner remains on the intermediate transfer material, that is, a so-called offset occurs. Although the offset can be reduced by using a material with good separability for the outer peripheral surface of the intermediate transfer material, when the temperature of the toner is high and its fluidity is high, the offset comes to be apt to occur.

On the other hand, as to the system in which the toner image transferred onto the recording member is fixed by heating, a technique for decreasing consumed thermal energy is disclosed in Japanese Patent Unexamined Publication No. Hei. 8-76620.

An apparatus disclosed in this publication uses a phenomenon that a magnetic field is applied to a heat generating member including a conductive layer so that eddy current is generated in the heat generating layer and the conductive layer having resistance is heated by this eddy current. That is, the recording member being in close contact with the heat generating member and the toner image held on the recording member are heated/melted by the heat generation of the conductive layer, so that the toner image is fixed onto the recording member.

By such a structure, consumed electric power for melting the toner is suppressed to a low level. However, since the toner and the recording member are together sandwiched between the heat generating member and the pressing roller and are heated, as a result, the consumed energy can not be reduced very much. Besides, since the toner is heated at the press contact portion between the heat generating member and the pressing roller, the temperature of the toner in the vicinity of the outlet of the fixing region, that is, of the press contact portion becomes high. Thus, there is also a problem that the offset is apt to occur.

SUMMARY OF THE INVENTION

The present invention has been made in view of the foregoing problems, and provides an image recording apparatus in which thermal energy required for fixing is reduced and transfer efficiency is superior.

An image recording apparatus having a toner image holding and conveying member for holding a toner image on an endless peripheral surface thereof and conveying the toner image by circular movement of the peripheral surface, the toner image being transferred and fixed onto a recording member includes an electromagnetic induction heat generating layer embedded near the endless peripheral surface of the toner image holding and conveying member and an electromagnetic induction heat generating unit that generates fluctuating magnetic field penetrating the toner image holding and conveying member and causes heat generation of the electromagnetic induction heat generating layer by eddy current. The image recording apparatus further includes a sheet feeding unit that supplies the recording member to a position of the peripheral surface of the toner image holding and conveying member downstream in a direction of the circular movement with respect to a position where the electromagnetic induction heating unit is disposed, and a pressing unit that presses the recording member against the toner image on the toner image holding and conveying member heated and melted by the electromagnetic induction heat generating layer to transfer and fix the toner image onto the recording member.

In the image recording apparatus of such structure, the fluctuating magnetic field generated by the electromagnetic induction heating unit penetrates the electromagnetic induction heat generating layer of the toner image holding and conveying member, so that the eddy current is produced in this layer and heat is generated. By this, the toner image on the toner image holding and conveying member is heated and melted.

The melted toner is pressed by the pressing unit against the recording member supplied from the sheet feeding unit. At this time, the recording member is not heated and is kept at room temperature, so that the temperature of the pressed toner is instantly lowered. However, since the toner is sufficiently heated, the melted toner absorbs fibers of the recording member or permeates among the fibers and is adhered. Besides, when the toner passes through the nip portion where the recording member is pressed against the toner image holding and conveying member by the pressing unit, the temperature of the toner is further lowered and the fluidity is lessened. At the outlet of the nip portion, such a state is obtained that the entire toner is adhered to the recording member. Thus, when the recording member is separated from the toner image holding and conveying member, a phenomenon that the toner is divided and a part thereof remains at the side of the toner image holding and conveying member, that is, a so-called offset does not occur. The transfer is carried out at extremely high efficiency, and at the same time, fixing is made.

As described above, in this image recording apparatus, the toner image is heated and melted by heat generation of the electromagnetic induction heat generating layer. Heated portions are the electromagnetic induction heat generating layer in the vicinity of the peripheral surface of the toner image holding and conveying member, the layer formed thereon, and the toner. The toner can be melted without practically heating a portion below the electromagnetic induction heat generating layer, for example, a base layer if a material with low heat conductivity is used. Thus, the toner can be made a melted state in an extremely short time, and used energy can be decreased. Further, preliminary heating becomes unnecessary, so that setting of a waiting time becomes unnecessary when the image forming operation is started by making the power source of this image recording apparatus an ON state.

Since the melted toner is sufficiently heated, when it is pressed against the recording member of the unheated state, it is adhered to this recording member, and thereafter, the heat is absorbed by this recording member and the temperature is lowered. At this time, in the toner image holding and conveying member, only a limited portion at the peripheral surface side of the heat generating layer is heated up to a high temperature, and the amount of heat held by the toner and the toner image holding and conveying member is small. Thus, lowering of the temperature rapidly occurs. Thus, if the width of the nip portion where the recording member is pressed against the toner image holding and conveying member, is suitably set, the temperature of the toner at the outlet of the nip portion can be made a sufficiently low value and the offset can be prevented.

Moreover, as described above, only the vicinity of the peripheral surface of the toner image holding and conveying member and the toner held thereon are heated by the electromagnetic induction heating unit, and the toner can be made a melted state in an extremely short time. Thus, it becomes possible to selectively heat only a portion of the toner image holding and conveying member where the toner image exists. That is, it is possible to reduce the used electric power by making the electromagnetic induction heating unit an OFF state in a non-image portion between recorded images. Further, the electromagnetic induction heating unit including a core made of a magnetic material and an exciting coil wound on this core is made such a structure that the unit is divided into plural portions in the width direction of the image. Then, heating of the toner can be made by using only a necessary portion according to the size of an image to be formed, so that the electric power to be used can be reduced.

In the foregoing image recording apparatus, the toner image holding and conveying member may be made, for example, an intermediate transfer material, so that the toner image formed on the outer peripheral surface of a photosensitive drum or the like is temporarily transferred onto the intermediate transfer material, this toner image is heated and melted by the electromagnetic induction heating unit, and is transferred and fixed onto the recording member.

Moreover, the toner image holding and conveying member may be made an image holding material with an outer peripheral surface on which formation of a latent image and development are carried out. In such image recording apparatus, the electromagnetic induction heat generating layer is provided in the vicinity of the peripheral surface of the image holding material, the latent image is directly formed on this peripheral surface, and a toner is transferred from a developing unit to form a toner image. Then this toner image is melted by the electromagnetic induction heating unit, and is transferred and fixed onto the recording member. The image holding material can be an ionographic member in which an insulating material is used as a member forming the outer peripheral surface, and the latent image is formed by an ion current emitting unit. The image holding material may also be a xerographic member in which the outer peripheral surface includes a photosensitive layer and the latent image is formed by irradiation of image light. However, it is necessary to use a material in which its characteristics are not changed very much by heating.

DETAILED DESCRIPTION OF THE PREFERRED EMBODIMENTS

Preferred embodiments of the present invention will be described below with reference to the accompanying drawings.

<First Embodiment>

Figure 1:
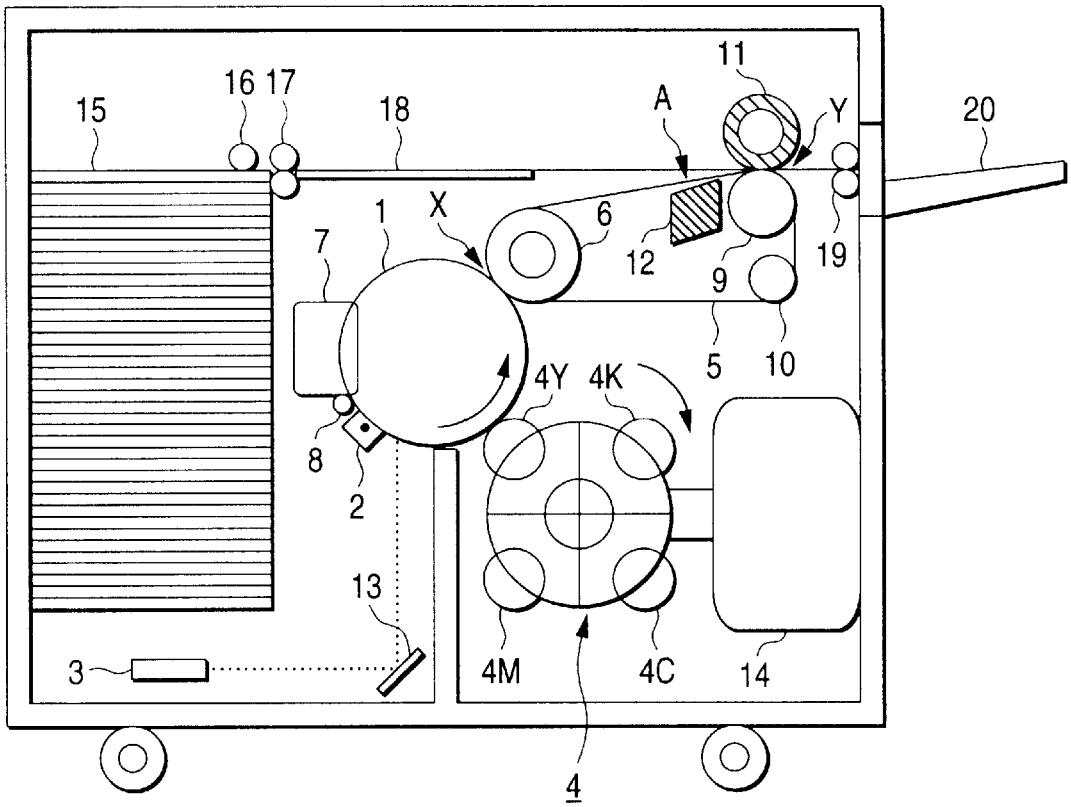
FIG. 1 is a schematic structural view showing an image recording apparatus of a first embodiment of the present invention.

FIG. 1 is a schematic structural view showing an image recording apparatus of this embodiment of the invention.

This image recording apparatus includes a photosensitive drum 1 with a surface on which a latent image is formed by a difference in electrostatic potential, and around this photosensitive drum 1, includes a charging unit 2 for charging the surface of the photosensitive drum almost uniformly, a light exposing portion composed of a laser scanner 3, a mirror 13, and the like for forming a latent image by irradiating the photosensitive drum 1 with laser light corresponding to each color signal, a rotary developing unit 4 containing four color toners of cyan, magenta, yellow, and black and making the latent image on the photosensitive drum visible by each color toner, an endless belt-like intermediate transfer material 5 supported so that circular movement in a fixed direction can be made, a primary transfer roller 6 disposed facing the photosensitive drum 1 through the intermediate transfer material 5 and for transferring a toner image onto the intermediate transfer material 5, a cleaning unit 7 for cleaning the surface of the photosensitive drum after transfer, and an exposing lamp 8 for diselectrifying the surface of the photosensitive drum 1.

Further, in the apparatus, there are provided a tension roller 9 arranged to extend the intermediate transfer material 5 together with the primary transfer roller 6, a driving roller 10, a pressing roller 11 disposed facing the tension roller 9 so that the intermediate transfer material 5 is sandwiched therebetween, a sheet feeding roller 16 and a registration roller 17 for conveying a recording member contained in a sheet feeding unit 15 one by one, and a recording member guide 18 for supplying the recording member into a portion between the intermediate transfer material 5 wound on the tension roller 9 and the pressing roller 11. Further, the apparatus includes an electromagnetic induction heating unit 12 which is located at an upstream side with respect to a position facing the pressing roller 11 in a circulating direction of the intermediate transfer material 5 and heats the toner image from the back side of the intermediate transfer material 5.

The photosensitive drum 1 includes a photosensitive material layer made of OPC, a-Si, or the like on the surface of a cylindrical conductive base material, and the conductive base material is electrically grounded.

The developing unit 4 includes four developing containers 4C, 4M, 4Y and 4K containing toners of cyan, magenta, yellow and black, respectively. The developing containers are rotatably supported so that each of the containers faces the photosensitive drum 1. Each of the developing containers includes a developing roller which forms a toner layer on its surface and conveys to the position facing the photosensitive drum 1. This developing roller is designed such that a voltage obtained by superimposing DC voltage of 400 V on a rectangle wave alternate voltage with an alternate voltage value $V_{P-P}$ of 2 kV and a frequency f of 2 kVHz is applied, and the toner is transferred to the latent image on the photosensitive drum 1 by the action of electric field. The toner is supplied to each of the developing containers 4C, 4M, 4Y and 4K from a toner hopper 14.

Figure 2:
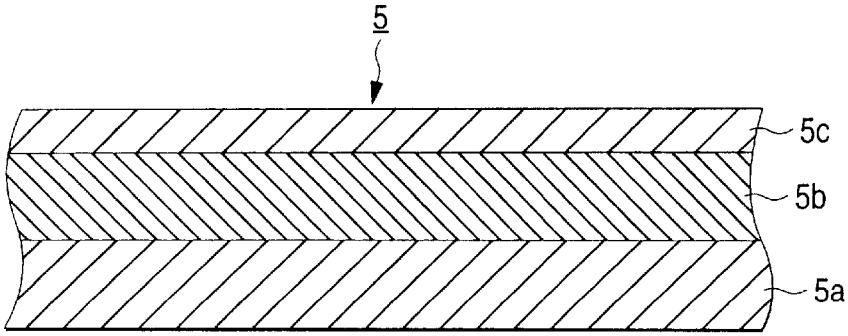
FIG. 2 is a schematic sectional view showing an intermediate transfer material used in the image recording apparatus.

FIG. 2 is a schematic sectional view showing the intermediate transfer material 5.

This intermediate transfer material 5 is composed of three layers, a base layer 5*a* made of a sheet-like member having high heat resistance, a conductive layer (electromagnetic induction heat generating layer) 5*b* formed thereon, and a surface release layer 5*c* of the uppermost layer. It is preferable that the base layer 5*a* is a semiconductive member with a thickness of 10 μm to 100 μm. For example, it is preferable to use a material of resin having high heat resistance typified by polyester, polyethylene terephthalate, polyether sulfone, polyether ketone, polysulfone, polyimide, polyimide amide, polyamide, and the like, and dispersed with a conductive material such as carbon black. The conductive material is dispersed in the base layer 5*a* in view of electrostatic transfer properties when the toner image is transferred by application of electric field at primary transfer. However, the structure of the base layer is not limited to this.

The conductive layer 5*b* is a layer of iron or cobalt, or a metal layer of nickel, copper, chromium, or the like made by plating treatment to have a thickness of 1 μm to 50 μm. The details of the conductive layer 5*b* will be described later.

The surface release layer 5*c* is preferably a sheet or coat layer with a high release property and with a thickness of 0.1 μm to 30 μm. For example, tetrafluoroethylene-perfluoroalkyl vinyl ether copolymer, polytetrafluoroethylene-silicone copolymer, or the like is used. Since the toner is brought into contact with the surface release layer 5*c*, the material has a great influence upon the image quality. In the case where the material of the surface release layer is an elastic member, close contact is realized in such a state that the member encompasses the toner, so that deterioration of the image is little, and an image gloss is uniform. However, in the case where the release material is a member having no elasticity, such as a resin, a toner is not easily brought into close contact with the recording member at the press contact portion against the intermediate transfer material 5. Thus, poor transfer and fixing and image gloss nonuniformity are apt to occur. Especially in the case of the recording member with large surface roughness, the defects are remarkable. Thus, it is desirable that the material of the surface release layer 5*c* is an elastic material. In the case where a resin is used for the material of the surface release layer, it is desirable that an elastic layer is included between the surface release layer 5*c* and the conductive layer 5*b*. In order to obtain the effect of encompassing the toner, it is preferable that the thickness of the elastic material in any case is at least 10 μm, preferably 20 μm or more.

Since the intermediate transfer material 5 is driven by the driving roller 10 and is circulated, the press contact portion of the intermediate transfer material 5 against the pressing roller 11 is moved at the same speed as the recording member through the rotation of the driving roller 10. At this time, the width of a nip and the moving speed of the recording member are set so that the time when the recording member exists in the nip between the pressing roller 11 and the intermediate transfer material 5 becomes 10 ms to 50 ms. The time when the toner exists in the nip, that is, the time from a time point when the melted toner is pressed against the recording member to a time point when the recording member is separated from the intermediate transfer material is made 50 ms or more as described above. Thus, even if the toner is heated up to a temperature sufficient for the toner to adhere to the recording member, the temperature of the toner at the outlet of the nip is lowered to such a degree that the offset does not occur.

Figure 3:
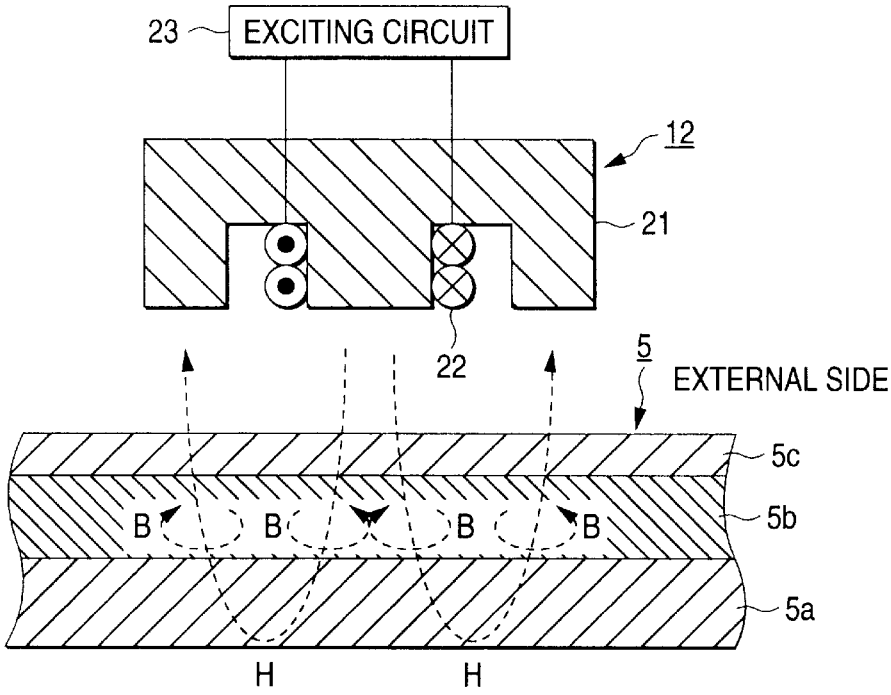
FIG. 3 is an explanatory view for explaining the heating principle of the intermediate transfer material by an electromagnetic induction heating unit.

FIG. 3 is an explanatory view showing the heating principle of the intermediate transfer material 5 by the electromagnetic induction heating unit 12.

The main portion of the electromagnetic induction heating unit 12 is constituted by, as shown in FIG. 3, an iron core 21 having a cross section of a downward E-shape, an exciting coil 22 wound around this iron core 21, and an exciting circuit 23 applying an alternating current to the exciting coil 22. When the alternating current is applied to the exciting coil 22, generation and disappearance of magnetic flux indicated by arrow H is repeated around the exciting coil 22. The heating unit 12 is arranged so that the magnetic flux H crosses the conductive layer 5*b* of the intermediate transfer material 5.

When the fluctuating magnetic field crosses the conductive layer 5*b*, eddy current indicated by arrow B is generated in the conductive layer 5*b* so as to generate a magnetic field to prevent the change of the fluctuating magnetic field. This eddy current flows almost on the surface of the conductive layer 5*b* at the side of the exciting coil 22 by the skin effect, and heat generation occurs by electric power in proportion to surface resistance Rs of the conductive layer 5*b*.

When angular frequency is $\omega$, magnetic permeability is $\mu$, and intrinsic resistance is $\rho$, the skin depth $\delta$ is expressed by the following equation.

$$\delta=\sqrt{(2\rho/\omega\mu)} \quad \text{[equation 1]}$$

Further, the skin resistance Rs is expressed by the following equation.

$$Rs=\rho/\delta=\sqrt{(\omega\mu\rho/2)} \quad \text{[equation 2]}$$

When current flowing in the intermediate transfer material is i, electric power P generated in the conductive layer air 5*b* of the intermediate transfer material 5 is expressed by the following equation.

$$P=Rs\int|i|2dS \quad \text{[equation 3]}$$

Thus, if the skin resistance Rs is made large or the current i flowing in the intermediate transfer material is made large, the electric power P can be increased and the amount of heat generation can be increased. The skin resistance Rs can be increased by raising the frequency $\omega$ or by using a material with high magnetic permeability $\mu$ or high intrinsic resistance $\rho$.

From the foregoing heating principle, it is inferred that when a nonmagnetic metal is used for the conductive layer 5*b*, it is difficult to heat the intermediate transfer material. However, in the case where the thickness t of the conductive layer 5*b* is smaller than the skin depth $\delta$, the following equation is obtained, so that heating becomes possible.

$$Rs\approx\rho/t \quad \text{[equation 4]}$$

It is preferable that the frequency of alternating current applied to the exciting coil 22 is 10 to 500 kHz. When the frequency is 10 kHz or more, the absorption efficiency to the conductive layer 5*b* becomes excellent, and until 500 kHz, the exciting circuit 23 can be assembled by using inexpensive components. Further, when the frequency is 20 kHz or more, it exceeds an audible range so that a sound is not produced at the current application. When the frequency is 200 kHz or less, a loss generated in the exciting circuit is little, and a radiation noise to the surrounding is low.

In the case where alternating current of 10 to 500 kHz is applied to the conductive layer 5*b*, the skin depth is about several $\mu$m to hundreds $\mu$m. When the thickness of the conductive layer 5*b* is made smaller than 1 $\mu$m, almost all electromagnetic energy is not absorbed by the conductive layer 5*b*, so that energy efficiency becomes low. Besides, there occurs a problem that a leaked magnetic field heats other metal portions.

On the other hand, when the thickness of the conductive layer 5*b* exceeds 50 $\mu$m, thermal capacity of the intermediate transfer material becomes too large, and heat is conducted through heat conduction in the conductive layer 4*b*, so that there occurs a problem that the release layer 5*c* comes to be hard to heat. Thus, it is preferable that the thickness of the conductive layer 5*b* is 1 $\mu$m to 50 $\mu$m.

For the purpose of increasing the heat generation of the conductive layer 5*b*, the current i flowing in the intermediate transfer material is made large. For that purpose, the magnetic flux generated by the exciting coil 22 is intensified or the change of magnetic flux is made large. As this method, it is appropriate that the number of winding lines of the exciting coil 22 is increased, or the iron core 21 of the coil 22 is made of a material having high magnetic permeability and low residual magnetic flux density, such as ferrite or permalloy.

If the resistance value of the conductive layer 5*b* is too small, heat generating efficiency when the eddy current is generated becomes worse. Thus, it is preferable that the intrinsic volume resistance of the conductive layer 5*b* is $1.5\times10^{-8}$ $\Omega$m or more in the environment of 20° C.

In this embodiment, although the conductive layer 5*b* is formed by plating or the like, it may be formed by vacuum evaporation, sputtering, or the like. By this, aluminum or metal oxide alloy which can not be subjected to the plating treatment, can be used for the conductive layer 5*b*. However, since a desired film thickness, that is, a layer thickness of 1 to 50 $\mu$m is easily obtained by the plating treatment, the plating treatment is is preferable.

When a ferromagnetic material, such as iron, cobalt, or nickel, with high magnetic permeability is used for the material of the conductive layer 5*b*, electromagnetic energy generated by the exciting coil 22 comes to be easily absorbed, so that heating can be made effectively. Further, magnetic field leaking to the outside is reduced, and influence upon peripheral units can be reduced. Thus, it is preferable that a material with high resistance is selected among these. The conductive layer 5*b* is not limited to metal, but the conductive layer 5*b* may be made by dispersing particles or whiskers with conductivity and high magnetic permeability in an adhesive for bonding the low heat conductive base layer 5*a* to the surface release layer 5*c*. For example, the conductive layer maybe formed by mixing and dispersing particles of manganese, titanium, chromium, iron, copper, cobalt, nickel, or the like, or particles or whiskers of ferrite of an alloy of those or oxide, or conductive particles of carbon black or the like, into the adhesive.

Next, the operation of the image recording apparatus having the foregoing structure will be described.

The photosensitive drum 1 rotates in the direction of an arrow shown in FIG. 1, and is charged by the charging unit 2 almost uniformly, and then, is irradiated with laser light which was subjected to pulse-width modulation in accordance with an yellow image signal of an original from the laser scanner 3. As a result, an electrostatic latent image corresponding to the yellow image is formed on the photosensitive drum 1. This electrostatic latent image for the yellow image is developed by the developing unit 4Y for yellow placed at a developing position in advance by the rotary developing unit 4, so that an yellow toner image is formed on the photosensitive drum 1.

This yellow toner image is electrostatically transferred onto the intermediate transfer material 5 by the action of the primary transfer roller 6 at the primary transfer portion X as a contact portion between the photosensitive drum 1 and the intermediate transfer material 5. This intermediate transfer material 5 circulates synchronously with the photosensitive drum 1, continues the circular movement while the yellow toner image is held on the surface, and prepares for a transfer for a next magenta image.

On the other hand, after the surface of the photosensitive drum 1 is cleaned by the cleaning unit 7, the drum is again charged by the charging unit 2 almost uniformly, and is irradiated with laser light from the laser scanner 3 in accordance with the next magenta image signal.

The rotary developing unit 4 is rotated while the electrostatic latent image for magenta is formed on the photosensitive drum 1, so that the developing unit 4M for magenta is placed at the developing position and development by a magenta toner is carried out. The magenta toner image formed in this way is electrostatically transferred onto the intermediate transfer material 5 at the primary transfer portion X.

Subsequently, the foregoing process is carried out for cyan and black, respectively. When the transfer for the four colors onto the intermediate transfer material 5 is ended, or in the middle of the transfer for black, the final color, a recording member (sheet) contained in the sheet feeding unit 15 is fed by the paper feeding roller 16, and is conveyed to a secondary transfer portion Y of the intermediate transfer material 5 through the registration roller 17 and the recording member guide 18.

On the other hand, the four color toner images transferred onto the intermediate transfer material 5 pass through a heating region A facing the electromagnetic induction heating unit 12 at the upstream side of the secondary transferring portion Y. In the heating region A, alternating current is applied from the exciting circuit 23 to the exciting coil 22, and the conductive layer **5*b* of the intermediate transfer material 5 is heated by electromagnetic induction heating. By this, the conductive layer 5*b* is rapidly heated. This heat is conducted to the surface layer with the lapse of time, and when the heated portion reaches the secondary transfer portion Y, the toner on the intermediate transfer material 5** becomes a melted state.

The toner image melted on the intermediate transfer material 5 is brought into close contact with the recording member at the secondary transfer portion Y by the pressure of the pressing roller 11 which is pressed in accordance with the conveyance of the recording member. In the heating region A, only the vicinity of the surface of the intermediate transfer material 5 is locally heated, and the melted toner is rapidly cooled through the contact with the recording member of room temperature. That is, when the melted toner passes through the nip of the secondary transfer portion Y, it is instantly penetrated into the recording member by the thermal energy of the toner and the pressing force so that transfer and fixing are made. The recording member is conveyed to the outlet of the nip while absorbing the heat of the toner and the intermediate transfer material in which only the vicinity of the surface is heated. At this time, the nip width and the moving speed of the recording member are suitably set, so that the temperature of the toner at the nip outlet becomes lower than the softening point temperature. Thus, the cohesive force of the toner becomes large, and the toner image does not produce an offset but is transferred and fixed onto the recording member almost completely as it is.

Thereafter, the recording member on which the toner image has been transferred and fixed, passes through a discharging roller 19 and is discharged to a tray 20 for discharge, so that full-color image formation is ended.

Incidentally, the softening point temperature of a toner is obtained by a measuring method described below.

A flow tester CFT-500 A type (Simadzu Corp.) is used. The diameter of a die (nozzle) is 0.2 mm, the length thereof is 1.0 mm, and the cross section of a plunger is 1.0 $cm^2$. Finely weighted fine particles of 1 to 3 g are used as a toner of a sample. After an extruding load of 20 kg is applied to the toner, and preliminarily heating at an initial set temperature of 70° C. for 300 seconds is carried out, temperature is raised at a constant rate of 6° C./minute, and an amount of melted toner flown out of the die (nozzle) is measured. When a plunger drop amount-temperature curve of the toner (hereinafter referred to as an S-shaped curve) at this time is obtained, it becomes a curve as shown in FIG. 4.

Figure 4:
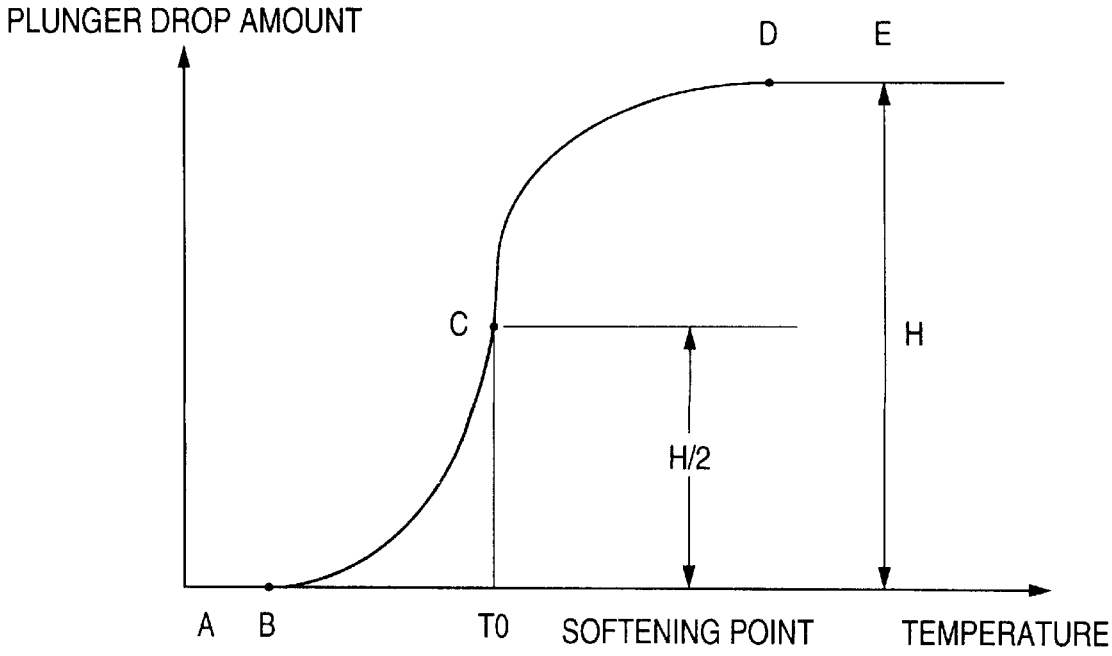
FIG. 4 is a view for explaining measuring method of softening point temperature of toner used in the image recording apparatus.

As shown in FIG. 4, the toner is gradually heated with the constant temperature rise, and the outflow is started (plunger drop A→B). When the temperature is further raised, the toner in a melted state flows out largely (B→C→D), and almost all toner is flown out, so that the plunger drop is stopped (D→E). The height H of the S-shaped curve indicates the total outflow amount. The temperature TO corresponding to point C where the amount of outflow toner becomes ½ of the total amount, that is, becomes H/2 is defined as the softening point temperature of the toner.

Figure 5:
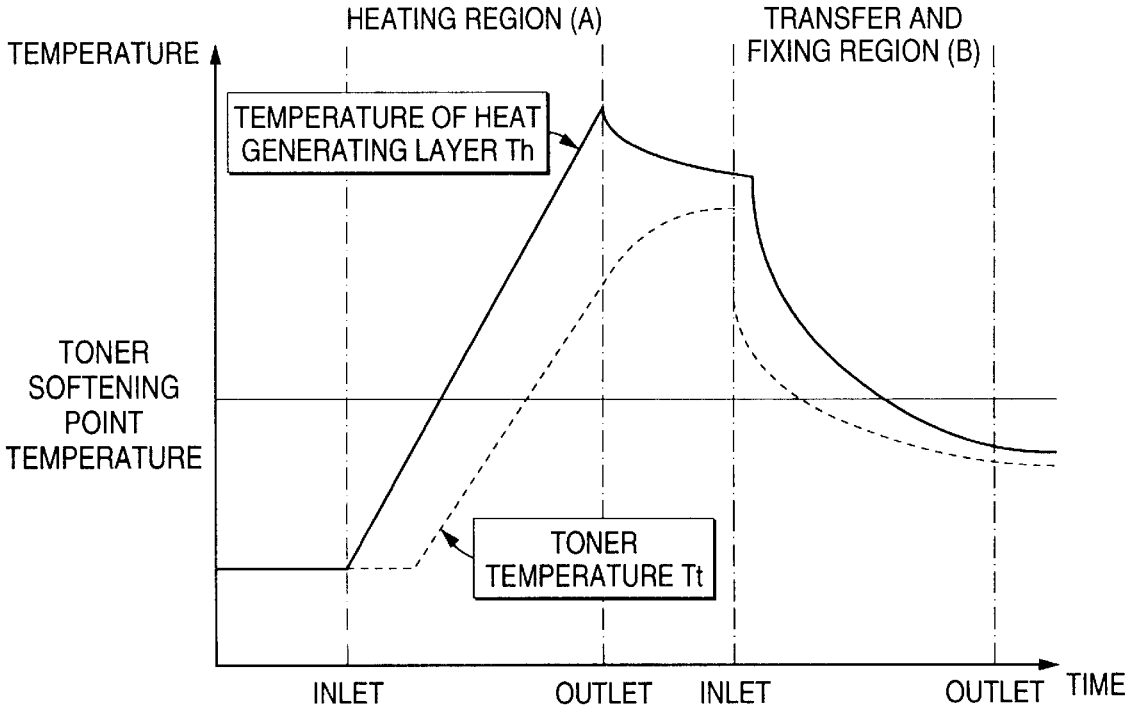
FIG. 5 is a view showing temperature change of a toner in a heating region and a transfer and fixing region of the image recording apparatus.

FIG. 5 is a graph showing temperature change of the toner and the conductive layer (heat generating layer) **5*b* from a time point just before the intermediate transfer material 5** passes through the heating region A to a time point when it passes through the outlet of the transfer and fixing region (nip of the secondary transfer portion Y).

As shown in FIG. 5, the conductive layer **5*b* is heated in the heating region A, and the temperature Th of the conductive layer 5*b* rapidly rises from room temperature. The toner temperature Tt rises a little later than the temperature Th of the conductive layer 5*b* since thermal resistance of the surface release layer 5*c* exists. However, since the thickness of the surface release layer 5*c* is as thin as several $\mu$m to tens $\mu$m, the delay is at most several to 10 msec. After passing through the heating region A, the conductive layer 5*b* is not heated, and the temperature of the conductive layer 5*b* is lowered since the heat is absorbed by the surrounding base layer 5*a* and the surface release layer 5*c*. Even after passing through the heating region A, the temperature of the toner is raised until the toner reaches the transfer and fixing region B since there is heat conduction from the surface release layer 5*c*. The toner and the intermediate transfer material 5 come in contact with the recording member of room temperature at the inlet of the transfer and fixing region B, so that the temperature is rapidly lowered. If the toner temperature at the instant when the toner comes in contact with the recording member is lower than the toner softening point temperature, the adhesive force exerting on the interface between the toner and the recording member is not sufficient, so that poor fixing occurs. Thus, it is necessary to control the heat amount of the electromagnetic induction heating unit 12 so that the toner temperature at the instant when the toner comes in contact with the recording member becomes at least the toner softening point temperature or more. Thereafter, the toner temperature is dropping as the toner advances to the outlet of the transfer and fixing region B, and is lowered to a temperature less than the toner softening point temperature. At the inlet of the transfer and fixing region B, the temperature of the conductive layer 5*b*** and the toner becomes almost an equilibrium temperature.

Like this, in the image recording apparatus of this embodiment, in the heating region A where the intermediate transfer material 5 faces the electromagnetic induction heating unit 12, only the vicinity of the conductive layer of the intermediate transfer material 5 absorbing an electromagnetic wave is heated. In the transfer and fixing region B, the toner heated and melted in the heating region A is brought into press contact with the recording member of room temperature, so that transfer and fixing are carried out at the same time. Since only the surface of the intermediate transfer material 5 is heated, the temperature of the intermediate transfer material 5 is rapidly lowered immediately after the transfer and fixing. Thus, heat accumulation in the apparatus becomes extremely small.

On the other hand, in a conventional image recording apparatus in which transfer and fixing are carried out at the same time, in the case where the apparatus is continuously used, heat is accumulated and the temperature rise of the apparatus due to this becomes remarkable. Thus, the potential characteristic of the photosensitive drum becomes unstable. Especially, lowering of charging potential becomes remarkable, and in the case where reversal development is, for example, used as a toner image forming method, surface fogging comes to occur on the background portion, and deterioration of image quality becomes remarkable. Further, such a phenomenon is also seen that the toner is melted in the vicinity of the developing unit by the temperature rise of the apparatus, and the toner adheres to the cleaning blade and the like. On the other hand, in the image recording apparatus of this embodiment, temperature rise in the apparatus when it is continuously used is much lower than the conventional system, and the characteristics of the photosensitive drum and the toner are hardly changed. Thus, deterioration of image quality is hardly seen even in long use, and an image of high quality can be stably obtained. Especially, this effect is remarkable when a color image is formed.

From the above, in the image recording apparatus of this embodiment, there are merits specifically shown in the following.

Since the vicinity of the surface of the intermediate transfer material is directly heated by the electromagnetic induction heating unit, rapid heating can be made without receiving an influence of thermal conductivity and thermal capacity of the base layer of the intermediate transfer material.

Moreover, since heating does not depend on the thickness of the intermediate transfer material, in the case where it is necessary to raise the rigidity of the intermediate transfer material, even if the base layer (base material) of the intermediate transfer material is made thick, the toner can be rapidly heated to a fixing temperature.

The base layer of the intermediate transfer material is made of a resin of low heat conductivity so that it is superior in heat insulation, and even if continuous printing is carried out, the thermal loss is small. When a region where an image does not exist, for example, a non-image portion between continuously fed recording members passes through the heating region A, the exciting circuit is controlled so that wasteful heating can be stopped. By these together, the energy efficiency becomes very high. The temperature rise in the apparatus can be suppressed by the improvement of the thermal efficiency, and it is also possible to prevent the change of characteristic of the photosensitive drum, the adhesion of the toner to the cleaning member, and the like.

Incidentally, the above embodiment shows an example in which after all of the four color toner images are transferred onto the intermediate transfer material, the toner images are heated and melted by the electromagnetic induction heating unit. However, such a system may be adopted that after primary transfer of each toner image is carried out for each color, the toner image is heated and melted, and temporary fixing of the toner is carried out onto the intermediate transfer material. Such a system has merits that it is possible to prevent the superimposed toner images of four colors from being disturbed after primary transfer, and the registration and magnification of the images can be adjusted with high accuracy.

In the embodiment, as a transfer method at the primary transfer portion X, an electrostatic transfer method is used ilk in which a bias applying roller having an insulative dielectric layer is used, and a toner image is electrostatically transferred onto an intermediate transfer material. However, the invention may use other methods such as adhesive transfer in which an intermediate transfer material with elasticity and heat resistance is used, and a primary transfer roller is pressed against a photosensitive drum from the inside of the intermediate transfer material, so that a toner image is transferred onto the intermediate transfer material. At that time, since a small amount of toner remains on the photosensitive drum after transfer, it is necessary to diselectrify the remaining toner by a diselectrifying unit and to make cleaning by a cleaning unit.

<Second Embodiment>

Figure 6:
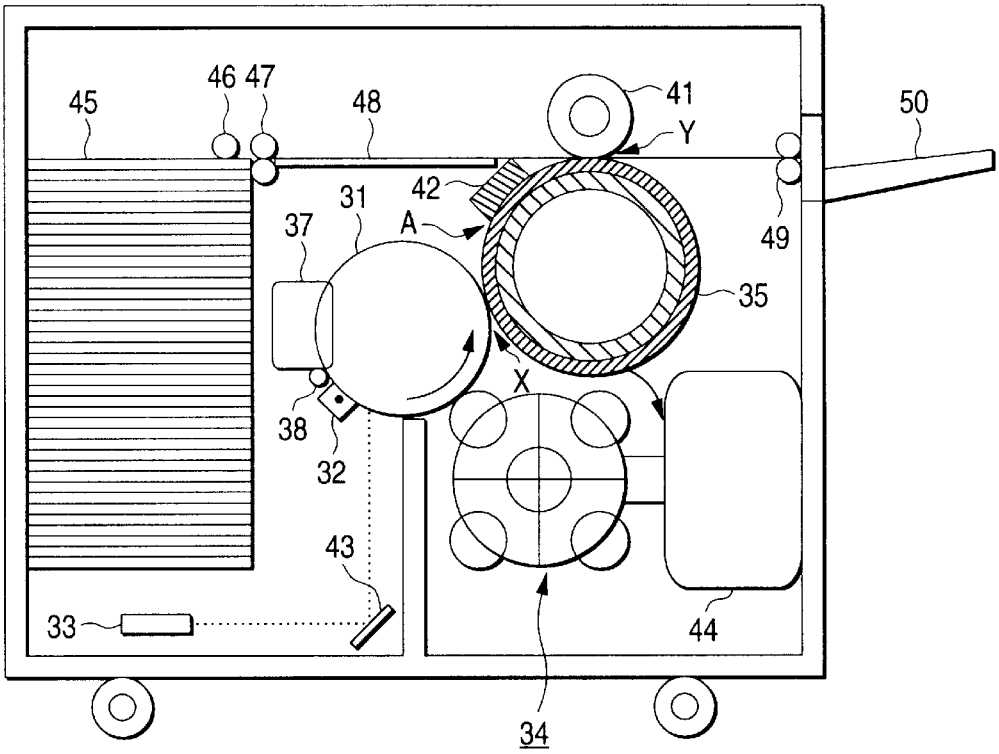
FIG. 6 is a schematic structural view showing an image recording apparatus of a second embodiment of the present invention.

FIG. 6 is a schematic structural view showing an image recording apparatus of this embodiment of the present invention.

Similarly to the apparatus shown in FIG. 1, this image recording apparatus includes a photosensitive drum 31, a charging unit 32, a laser scanner 33, a rotary developing unit 34, a cleaning unit 37, an exposure lamp 38, a pressing roller 41, a sheet feeding unit 45, a sheet feeding roller 46, a registration roller 47, a recording member guide 48, and the like. However, instead of the belt-like intermediate transfer material 5 shown in FIG. 1, a roll-like intermediate transfer material 35 is provided. At the upstream side of a secondary transfer portion Y in a toner image transfer direction of the intermediate transfer material 35, an electromagnetic induction heating unit 42 is provided to be near and facing the outer peripheral surface of the intermediate transfer material 35.

Figure 7:
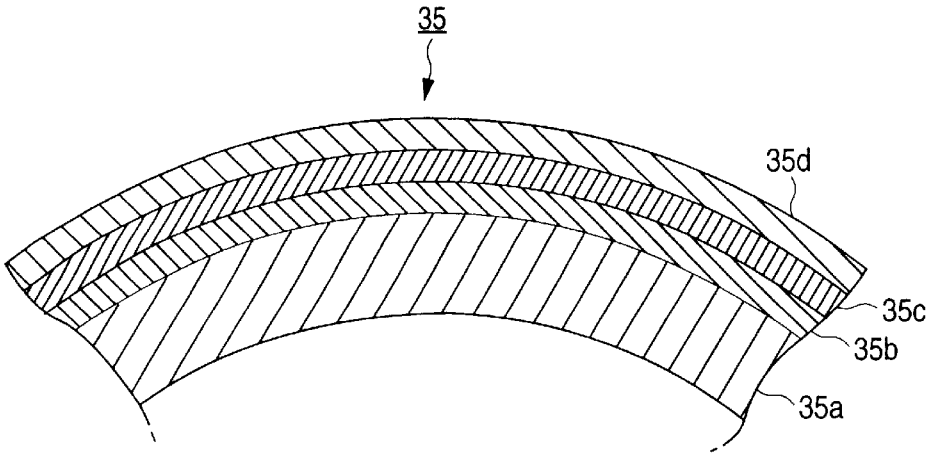
FIG. 7 is a schematic sectional view of an intermediate transfer material used in the image recording apparatus shown in FIG. 6.

The intermediate transfer material 35 includes, as shown in FIG. 7, a base material roller 35*a* made of porous ceramic and having heat insulating property, a conductive layer 35*b* formed on the base material roller 35*a* and made of a nickel plating layer with a thickness of 5 $\mu$m, a release layer 35*c* formed on the conductive layer 35*b* and covered with silicone rubber with a thickness of 30 $\mu$m and a heat-resistant resin layer 35*d* of polyimide with a thickness of 20 $\mu$m as the uppermost layer.

Like the unit shown in FIG. 3, the electromagnetic induction heating unit 42 applies alternating current to an exciting coil from an exciting circuit, so that the conductive layer 35*b* of the intermediate transfer material 35 can be heated by electromagnetic induction heating.

Other structures of this image recording apparatus are the same as the image recording apparatus shown in FIG. 1.

In such image recording apparatus, since only the vicinity of the surface of the intermediate transfer material 35 including the conductive layer 35*b* is heated by the electromagnetic induction heating unit 42, a toner on the intermediate transfer material 35 is almost instantly heated and is melted. Further, since the intermediate transfer material 35 is only locally heated, when the melted toner comes in contact with a recording member of room temperature at a secondary transfer portion Y, it is rapidly cooled. That is, the melted toner is instantly transferred and fixed when it is brought into press contact with the recording member at the nip of the secondary transfer portion Y, and thereafter, it is cooled while it is conveyed to the outlet of the nip. The temperature of the toner is sufficiently lowered at the outlet of the nip, and the cohesive force of the toner is large, so that an offset and the cohesive force of the toner is large, so that an offset does not occur and a toner image is transferred and fixed onto the recording member practically without any change.

Since the electromagnetic induction heating unit 42 can heat the vicinity of the surface of the intermediate transfer material 35 rapidly and selectively, even in the case where the intermediate transfer material is a roller having large thermal capacity, the toner image can be rapidly heated up to the softening point temperature. Thus, it is possible to realize the image recording apparatus with extremely high thermal efficiency.

<Third Embodiment>

Figure 8:
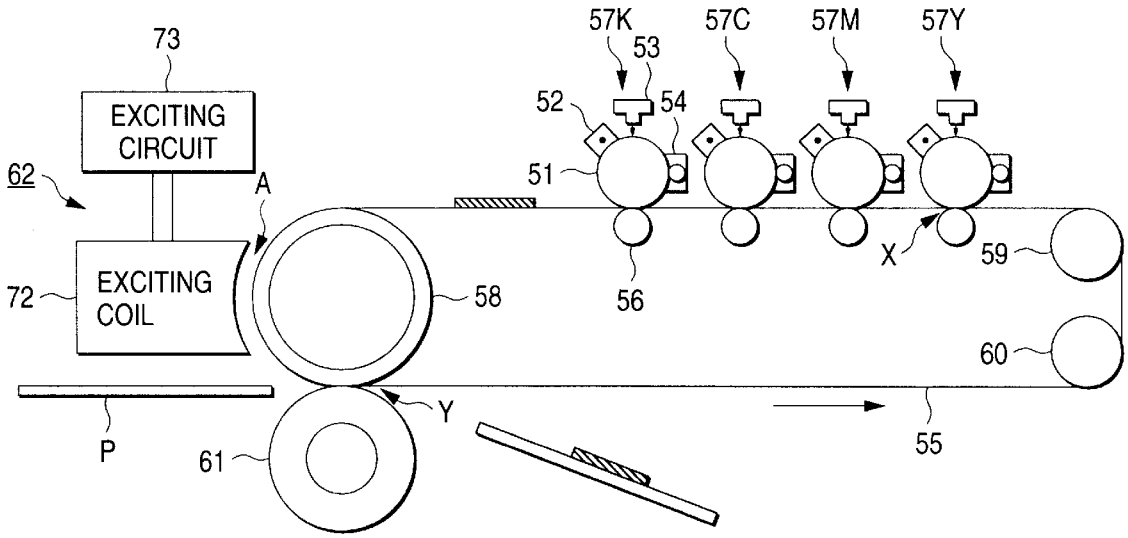
FIG. 8 is a schematic structural view showing an image recording apparatus of a third embodiment of the present invention.

FIG. 8 is a schematic structural view showing an image recording apparatus of another embodiment of the present invention.

This image recording apparatus includes an endless belt-like intermediate transfer material 55 with a peripheral surface which circulates. Four image forming units 57Y, 57M, 57C, and 57K for forming yellow, magenta, cyan, and black toner images are disposed at positions facing this intermediate transfer material 55. Like the unit shown in FIG. 1, each of the image forming units includes a photosensitive drum 51 with a surface on which an electrostatic latent image is formed, a charging unit 52 for uniformly charging the surface of the photosensitive drum, an exposing unit 53 for forming the latent image by irradiation of laser light to the photosensitive drum, a developing unit 54 for forming a toner image by selectively transferring a toner to the latent image on the photosensitive drum, and a primary transfer roller 56 which is disposed facing the photosensitive drum 51 through the intermediate transfer material 55 and transfers the toner image on the photosensitive drum onto the intermediate transfer material 55.

A secondary transfer roller 58, a driving roller 59, and a tension roller 60 are disposed in the inside of the intermediate transfer material 55, and the intermediate transfer material 55 is supported by these and is capable of circulating. At the downstream side of each of the image recording units in a circulating direction of the intermediate transfer material 55, there is provided a pressing roller 61 to press the intermediate transfer material 55 against the side of the secondary transfer roller 58. A recording member P is fed by not-shown conveying means to the secondary transfer portion Y where the intermediate transfer material 55 is brought into press contact with the pressing roller 61. Similarly to that shown in FIG. 2, the structure of the intermediate transfer material 55 is a three-layer structure of a base layer, a conductive layer, and a surface release layer.

At the upstream side of the secondary transfer portion Y in the circular direction of the intermediate transfer material 55, there is provided an electromagnetic induction heating unit 62 for heating the toner image transferred onto the intermediate transfer material 55. This electromagnetic induction heating unit 62 includes an exciting coil 72, an exciting circuit 73 and the like, similarly to the unit shown in FIG. 3, and is designed such that the conductive layer of the intermediate transfer material 55 is heated by electromagnetic induction heating.

In such image recording apparatus, image information is decomposed into images of four colors of cyan (C), magenta (M), yellow (Y) and black (K), and toner images of different colors are formed on the photosensitive drum 51 by the respective image formation units 57Y, 57M, 57C and 57K. The intermediate transfer material 55 circulates in a specific direction, and the toner image is transferred from the photosensitive drum 51 at the primary transfer portion X. After the toner images are sequentially transferred from the four image forming units and are superimposed, the four color toner images are conveyed to the heating region A facing the electromagnetic induction heating unit 62 by the movement of the intermediate transfer material 55.

In this heat region A, the four color toner images on the intermediate transfer material 55 are melted by heat generation of the conductive layer through electromagnetic induction heating. The melted toners are brought into press contact with the recording member of room temperature at the secondary transfer portion Y, so that the toner images are instantly permeated in the recording member and are transferred and fixed. Further, the toner images are cooled in a period in which the images are conveyed to the outlet of the nip. At the outlet of the nip, the temperature of the toner is sufficiently low, and the cohesive force of the toner is large, so that an offset does not occur and the toner images are transferred and fixed onto the recording member practically without receiving any change.

The apparatus of the tandem system in which the four image forming units are arranged has high productivity about four times that of the system in which one photosensitive drum is used in four cycles as shown in FIG. 1. Thus, a color image can be obtained at high speed. However, in the case of the four cycle system, transfer and fixing onto the recording member is once every four cycles. On the other hand, in the tandem system, recording members are continuously fed, so that thermal load to the intermediate transfer material becomes large, and a problem that the temperature of the photosensitive drum is raised comes to easily occur. A conventional apparatus of the tandem system has not been able to solve this problem. However, in the image recording apparatus of this embodiment, since the intermediate transfer material 55 is locally and selectively heated by the electromagnetic induction heating unit 62, there is a merit that even if an image is formed at high speed, heat is hardly accumulated in the intermediate transfer material. Besides, since the toner image on the intermediate transfer material 55 can be quickly heated, consumed energy can be suppressed to a low level.

<Fourth Embodiment>

Figure 9:
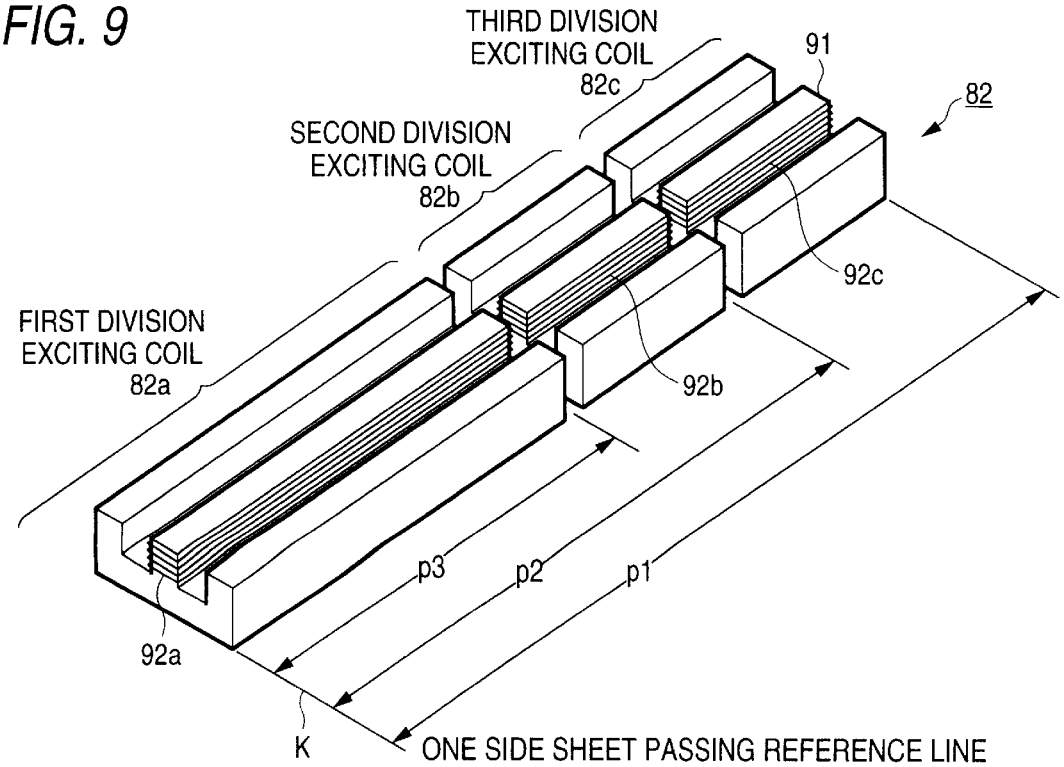
FIG. 9 is a schematic structural view showing an electromagnetic induction heating unit used in an image recording apparatus of a fourth embodiment of the present invention.

FIG. 9 is a schematic structural view showing an electromagnetic induction heating unit used in an image recording apparatus of this embodiment of the present invention.

Although the image recording apparatus of this embodiment has almost the same structure as the image recording apparatus shown in FIG. 1, an electromagnetic induction heating unit is replaced by a unit shown in FIG. 9.

This electromagnetic induction heating unit 82 is structured such that an iron core 91 and an exciting coil 92 as magnetic field generating means are divided into first to third exciting coil units 82*a*, 82*b*, and 82*c* in the longitudinal direction, that is, in the direction crossing the moving direction of the intermediate transfer material. Reference character K shown in the drawing indicates one side sheet passing reference line along which a recording member passes. Reference characters P1, P2, and P3 shown in the drawing indicate sheet passing regions through which recording members of three width sizes, large, medium and small, pass along the one side sheet passing reference line as the baseline, and has relation of P1>P2>P3. The total length of the first to third exciting coil units 82*a*, 82*b*, and 82*c* almost corresponds to the sheet passing region P1 for the large size recording member. The total length of the first and second exciting coil units 82*a* and 82*b* almost corresponds to the sheet passing region P2 for the medium size recording member. The total length of the first exciting coil unit 82*a* almost corresponds to the sheet passing region P3 for the small size recording member.

Current application to each of exciting coils 92*a*, 92*b*, and 92*c* of the first to third exciting coil units is controlled so that an ON or OFF state can be independently selected according to the size width of the passing recording member. That is, the existence of an image in the regions on the intermediate transfer material facing the first to third exciting coil units 82*a*, 82*b*, and 82*c* is detected by a sensor (not shown) or the like, so that such control is made that current is applied to all exciting coils 92*a*, 92*b*, and 92*c* for the large size recording member, two exciting coils 92*a* and 92*b* for the medium size recording member, and one exciting coil 92*a* for the small size recording member.

In such electromagnetic induction heating unit 82, the divided exciting coil units are used, so that consumed power can be reduced when the small size recording member passes, and temperature rise in the apparatus can be suppressed. Thus, this unit has a merit that thermal influence upon the photosensitive drum can be reduced. Conventionally, irrespective of a distribution region of images, energy comparable to energy necessary for transfer and fixing of toner images formed on the whole surface is always consumed. On the other hand, in this embodiment, current application to a non-image portion is stopped by the divided exciting coil units, so that electric power can be supplied according to images to be formed, and there is a merit that consumed power can be further reduced.

<Fifth Embodiment>

Figure 10:
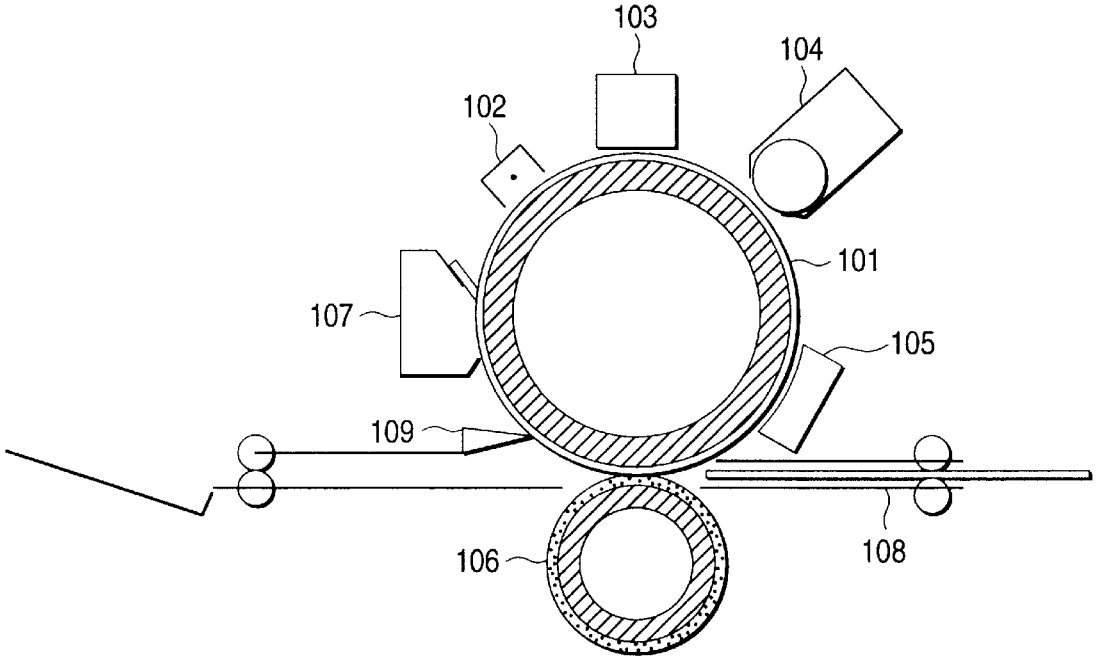
FIG. 10 is a schematic structural view showing an image recording apparatus of a fifth embodiment of the present invention.

FIG. 10 is a schematic structural view showing an image recording apparatus of this embodiment of the present invention.

This image recording apparatus uses a system in which a toner image developed on a recording drum is not intermediately transferred but is directly transferred and fixed onto a recording member from the recording drum, and an ionography is used as latent image forming means. Around a recording drum 101, this apparatus includes a charging unit 102 for almost uniformly charging the surface of the recording drum 101, a recording head 103 for forming a latent image by the action of corona ion current to this recording drum, a developing unit 104 for developing the latent image formed on the recording drum 101 by adhesion of toner, an electromagnetic induction heating unit 105 for melting the developed toner image by heating, a pressing roller 106 for pressing the melted toner image against a recording member fed along a recording member guide 108, a stripper claw 101, and a cleaning unit 107 for cleaning the toner on the recording drum 101.

Figure 11:
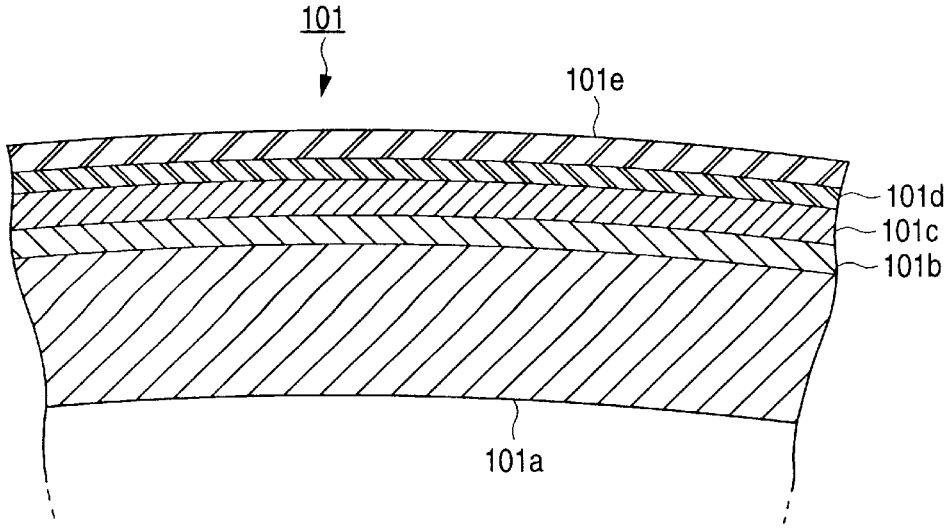
FIG. 11 is a schematic sectional view of a recording drum used in the image recording apparatus shown in FIG. 10.

Since the toner image on the surface is directly melted by heating, heat resistance and toner release property are required for the recording drum 101, and an insulating recording drum is adopted to satisfy them. In this embodiment, as shown in FIG. 11, the drum includes a heat insulating layer 101*b* on a peripheral surface of a base roller 101*a*, a base layer 101*c* formed thereon and having a thickness of 1 $\mu$m to 50 $\mu$m, a conductive layer 101*d* further formed thereon and having a thickness of 1 $\mu$m to 50 $\mu$m, and a recording layer 101*e* having a thickness of 1 $\mu$m to 100 $\mu$m as the uppermost layer. As the heat insulating layer 101*b*, a material with a thermal conductivity of $5\times10^{-4}$ cal/sec·cm·sec or less, for example, a foamed material made of an organic material or an inorganic material, ceramics, cellulose or the like, is used. For the base layer 101*c*, for example, polyimide, polyamideimide, or the like is used. For the conductive layer 101*d*, a material with an intrinsic volume resistivity of $1.5\times10^{-8}$ Ωm or more, for example, nickel, iron, cobalt, aluminum, copper or the like is used. For the recording layer 101*e*, a material with a resistivity of $10^{12}$ Ω·cm or more and a dielectric constant of 1.5 to 40, for example, polytetrafluoroethylene (dielectric constant of 2 to 3), another fluorocarbon copolymer, silicone rubber (dielectric constant of 2.6 to 3.3), or the like is used. constant of 2.6 to 3.3), or the like is used.

The pressing roller 106 is an elastic roller coated with a heat-resistant elastic material such as silicone rubber or fluorine rubber.

The recording head 103 is of a stylus system in which a number of needle-like electrodes (about 300 dpi in this embodiment) are arranged for each pixel, and electric discharge is selectively produced from the needle-like electrodes according to an image signal. An ion current generated by this electric discharge is fixed on the recording drum so that an electrostatic latent image is formed.

Incidentally, the other structures of the image recording apparatus are the same as the image recording apparatus shown in FIG. 1.

In this image recording apparatus, after the recording drum 101 is almost uniformly charged by the charging unit 102, an electrostatic latent image is formed on the recording drum by emission of the ion current from the recording head 103, and this electrostatic latent image is developed by the developing unit 104. Thereafter, the conductive layer 101*d* of the recording drum 101 is heated by the electromagnetic induction heating unit 105, and the toner image on the recording drum is melted by heating. The melted toner image is pressed against the recording member of room temperature by the pressing roller 106, and the toner image is transferred onto the recording member and is fixed at the same time.

In such image recording apparatus, since the recording drum 101 is locally heated by the electromagnetic induction heating unit 105, consumed energy of the entire apparatus can be reduced. Besides, an intermediate transfer material is not used in this system, so that the apparatus has such merits that a step of image recording is simplified, and miniaturization of the apparatus can be achieved.

As the recording head for emitting the ion current according to image data, there are various systems of heads. Instead of the recording head 103, for example, an ion projection system may be used in which ions produced by corona discharge in an ion producing chamber are emitted as ion current from a fine nozzle on the basis of image data.

As described above, in the image recording apparatus of the present invention, fluctuating magnetic field is applied to the electromagnetic induction heat generating layer provided in the vicinity of the peripheral surface of the toner image holding and conveying member, and heat energy is given by heat generation due to eddy current generated in the electromagnetic induction heat generating layer. Thus, the vicinity of the peripheral surface of the toner image holding and conveying member can be selectively heated to melt the toner image, and accumulation of heat in the apparatus due to heating of the toner image holding and conveying member can be prevented. Thus, a stable output image can be obtained without producing change of characteristics of the toner image holding and conveying member. Moreover, utilization efficiency of thermal energy is extremely excellent, consumed energy of the entire of the apparatus can be reduced, and it becomes possible to make image formation at high speed by limited electric power. Moreover, since a warm-up time can be substantially eliminated, it is possible to cut down electric power which has been supplied to keep a heating member at set temperature when a conventional apparatus is on standby.

The recording member functions as a cooling member at transfer and fixing, so that the temperature of the toner image holding and conveying member is rapidly lowered. Thus, it becomes unnecessary to provide a large cooling unit, and the entire apparatus can be miniaturized. Moreover, since the heat amount of the recording member is small, transfer and fixing are hardly influenced by the thickness and thermal capacity of the recording member, setting of conditions of the apparatus becomes easy, and many curls, wrinkles or the like of the recording member are not produced.

What is claimed is:

1. An image recording apparatus having a toner image holding and conveying member for holding a toner image on an endless peripheral surface thereof and conveying the toner image by circular movement of the peripheral surface, the toner image being transferred and fixed onto a recording member comprising:

an electromagnetic induction heat generating layer embedded near the endless peripheral surface of the toner image holding and conveying member;

an electromagnetic induction heat generating unit that generates fluctuating magnetic field penetrating the toner image holding and conveying member and causes heat generation of the electromagnetic induction heat generating layer by eddy current;

a sheet feeding unit that supplies the recording member to a position of the peripheral surface of the toner image holding and conveying member downstream in a direction of the circular movement with respect to a position where the electromagnetic induction heat generating unit is disposed;

a pressing unit that presses the recording member against the toner image on the toner image holding and conveying member heated and melted by the electromagnetic induction heat generating layer to transfer and fix the toner image onto the recording member; and wherein a thickness of the electromagnetic induction heat generating layer is 1 $\mu$m to 50 $\mu$m.

2. The image recording apparatus as recited in claim 1, further comprising:

an image holding material on which a latent image is formed by difference of electrostatic potential; and a developing unit that forms a toner image by transferring a toner to the latent image, wherein the toner image holding and conveying member is an intermediate transfer material onto which the toner image formed on the image holding material is temporarily transferred.

3. The image recording apparatus as recited in claim 1, wherein the toner image holding and conveying member is an image holding material with a peripheral surface on which a latent image is formed by difference of electrostatic potential, the image holding material holding and conveying a toner image formed by transferring a toner to the latent image.

4. The image recording apparatus as recited in claim 1, wherein a heating temperature by the electromagnetic induction heat generating unit and a time required for the toner image to pass the nip portion are set so that a toner temperature at an inlet of the nip portion where the recording member is pressed against the toner image holding and conveying member and immediately after the toner image on the toner image holding and conveying member is pressed against the recording member is not less than a toner softening point temperature defined below, and a toner temperature at an outlet of the nip portion is less than the toner softening point temperature, wherein the toner softening point temperature is defined in such a manner that an extruding load of 20 Kg with a cross section of 1.0 $cm^2$ is applied to toner of 1 to 3 g, preliminary heating at an initial set temperature of 70° C. is carried out for 300 seconds, and temperature is raised at a constant rate of 6° C./minute, so that an amount of melted toner flown out of a nozzle with a diameter of 0.2 mm and a length of 1.0 mm is increased and becomes ½ of the whole amount at the toner softening point temperature.

5. The image recording apparatus as recited in claim 1, wherein a width of a nip portion and a circulating speed of the toner image holding and conveying member are set so that a time required for an arbitrary point to pass the nip portion where the recording member is pressed against the toner image holding and conveying member is 50 ms or more.

6. The image recording apparatus as recited in claim 1, wherein the toner image holding and conveying member is a roll-like member or an endless belt, a member forming an endless peripheral surface including a base layer, an electromagnetic induction heat generating layer formed thereon, and a release layer as an uppermost layer; and wherein the release layer is made of a material causing elastic deformation when the recording member is pressed against the release layer through the toner image.

7. The image recording apparatus as recited in claim 1, wherein the electromagnetic induction heat generating unit includes a core made of magnetic material, and an exciting coil wound around the core; and wherein the exciting coil is divided into areas corresponding to a plurality of sizes of the recording members.

8. The image recording apparatus as recited in claim 1, wherein the electromagnetic induction heat generating unit includes a core made of a magnetic material and an exciting coil wound around the core, current supplied to the exciting coil is controlled so that the coil is made an ON state when the coil faces an area of the toner image holding and conveying member where the toner image has been transferred, and the coil is made an OFF state when the coil faces an area where the toner image is not transferred.

9. An image recording apparatus having a toner image holding and conveying member for holding a toner image on an endless peripheral surface thereof and conveying the toner image by circular movement of the peripheral surface, the toner image being transferred and fixed onto a recording member, comprising:

an electromagnetic induction heat generating layer embedded near the endless peripheral surface of the toner image holding and conveying member;

an electromagnetic induction heat generating unit that generates fluctuating magnetic field penetrating the toner image holding and conveying member and causes heat generation of the electromagnetic induction heat generating layer by eddy current;

an output of the electromagnetic induction heating unit is set to achieve at least such a temperature that a toner in a melted state on the toner image holding and conveying member is adhered to the recording member at an inlet of a nip portion where the recording member is pressed against the toner image holding and conveying member;

a heating temperature by the electromagnetic induction heating unit and a time required for the toner to pass the nip portion are set so that a toner temperature at an outlet of the nip portion is lowered to such a temperature that fluidity of the toner is reduced and substantially the whole toner is adhered to the recording member between the toner image holding and conveying member and the recording member;

a sheet feeding unit that supplies the recording member to a position of the peripheral surface of the toner image holding and conveying member downstream in a direction of the circular movement with respect to a position where the electromagnetic induction heating unit is disposed; and a pressing unit that presses the recording member against the toner image on the toner image holding and conveying member heated and melted by the electromagnetic induction heat generating layer to transfer and fix the toner image onto the recording member.

10. An image recording apparatus having a toner image holding and conveying member for holding a toner image on an endless peripheral surface thereof and conveying the toner image by circular movement of the peripheral surface, the toner image being transferred and fixed onto a recording member, comprising:

an electromagnetic induction heat generating layer embedded near the endless peripheral surface of the toner image holding and conveying member;

an electromagnetic induction heat generating unit that generates fluctuating magnetic field penetrating the toner image holding and conveying member and causes heat generation of the electromagnetic induction heat generating layer by eddy current;

a sheet feeding unit that supplies the recording member to a position of the peripheral surface of the toner image holding and conveying member downstream in a direction of the circular movement with respect to a position where the electromagnetic induction heating unit is disposed;

a pressing unit that presses the recording member against the toner image on the toner image holding and conveying member heated and melted by the electromagnetic induction heat generating layer to transfer and fix the toner image onto the recording member; and wherein the toner image holding and conveying member is a roll-like member or an endless belt, a member forming an endless peripheral surface including a base layer, an electromagnetic induction heat generating layer formed thereon, an elastic layer further formed thereon, and a release layer as an uppermost layer.

* * * * *